US006430847B2

(12) United States Patent
Fusco et al.

(10) Patent No.: US 6,430,847 B2
(45) **Date of Patent: *Aug. 13, 2002**

(54) ASYMMETRIC SHOES

(75) Inventors: Ciro Fusco, Portland, OR (US); Wolfgang Scholz, Lonnerstadt (DE)

(73) Assignee: adidas International B.V., Amsterdam (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/390,573

(22) Filed: Sep. 3, 1999

Related U.S. Application Data

(63) Continuation-in-part of application No. 09/227,027, filed on Jan. 7, 1999, now abandoned.

(51) Int. Cl.[7] ..... A43B 5/00

(52) U.S. Cl. ..... 36/114; 36/72 R; 36/103; 36/113; 36/142

(58) Field of Search ..... 36/1, 45, 54, 72 R, 36/69, 81, 89, 77 R, 88, 92, 103, 109, 113, 115, 114, 131, 127, 142, 143, 144

(56) References Cited

U.S. PATENT DOCUMENTS

| | | | | | |
|---|---|---|---|---|---|
| 2,052,115 | A | * | 8/1936 | Shulman | 36/142 |
| 2,265,869 | A | * | 12/1941 | Scholl | 36/81 |
| 2,403,442 | A | * | 8/1946 | Klaus | 36/103 |
| 2,616,190 | A | | 11/1952 | Darby | 36/144 |
| 2,847,769 | A | * | 8/1958 | Schlesinger | 36/127 |
| 2,855,704 | A | | 10/1958 | Schlesinger | 36/144 |
| 3,124,887 | A | * | 3/1964 | Vassar | 36/81 |
| 3,738,373 | A | | 6/1973 | Glancy | 36/144 |
| 3,974,578 | A | * | 8/1976 | Oettinger et al. | 36/72 R |
| 4,180,924 | A | | 1/1980 | Subotnick | 36/129 |
| 4,266,553 | A | * | 5/1981 | Faiella | 36/142 |
| 4,364,189 | A | | 12/1982 | Bates | 36/129 |
| 4,373,275 | A | * | 2/1983 | Lydiard | 36/54 |
| 4,446,633 | A | * | 5/1984 | Scheinhaus et al. | 36/30 R |
| 4,575,953 | A | * | 3/1986 | Hetzel | 36/72 R |
| 4,620,376 | A | | 11/1986 | Talarico, II | 36/143 |
| 4,642,914 | A | * | 2/1987 | Caldeira | 36/54 |
| 4,676,010 | A | | 6/1987 | Cheskin | 36/32 |
| 4,685,227 | A | * | 8/1987 | Simmons | 36/127 |
| 4,704,809 | A | * | 11/1987 | Ballard | 36/127 |
| 5,052,130 | A | * | 10/1991 | Barry et al. | 36/114 |
| 5,075,984 | A | | 12/1991 | Shiew | 36/113 |
| 5,345,701 | A | | 9/1994 | Smith | 36/144 |
| 5,454,172 | A | * | 10/1995 | Crigger | 36/72 R |
| 5,575,091 | A | * | 11/1996 | Mattiuzzo | 36/88 |
| 5,865,778 | A | * | 2/1999 | Johnson | 36/88 |
| 5,933,986 | A | * | 8/1999 | Donnadieu | 36/89 |

FOREIGN PATENT DOCUMENTS

| | | | | |
|---|---|---|---|---|
| DE | 4100156 | * | 7/1992 | 36/89 |
| JP | 09028408 | | 2/1997 | |

* cited by examiner

*Primary Examiner*—M. D. Patterson
(74) *Attorney, Agent, or Firm*—Testa, Hurwitz & Thibeault, LLP

(57) ABSTRACT

The present invention relates to athletic shoes used in sports that require asymmetric movement of the feet, such as fencing. The asymmetric shoes of the present invention include a trailing shoe and a leading shoe that are each specially adapted to the particular asymmetric movement of the trailing and leading foot, respectively, allowing each foot to perform optimally. The leading and trailing shoes each include an upper and a sole. The trailing shoe sole includes front, rear, lateral, and medial portions, the lateral sole portion having a greater thickness than the medial portion.

13 Claims, 4 Drawing Sheets

ASYMMETRIC SHOES

CROSS-REFERENCE TO RELATED APPLICATION

This application incorporates by reference, and is a continuation-in-part of, U.S. patent application Ser. No. 09/227,027 which was filed on Jan. 7, 1999, now abandoned.

TECHNICAL FIELD

The present invention relates to an article of footwear. In particular, the present invention relates to athletic shoes used in sports that entail asymmetric movement of the feet, for example, fencing.

BACKGROUND OF THE INVENTION

Fencing is a sport involving attacking and defending with a sword or similar weapon. The rules and techniques of modern fencing are derived from those originally developed for swordplay in dueling. Three weapons are commonly used in modern fencing: the foil, the epée, and the saber. The blades are made of tempered steel with a maximum length of about 89 centimeters (35 inches). The foil is light and flexible and is considered the basic weapon. The epée, like the foil, is a thrusting weapon, however it is heavier and more rigid than the foil. The saber is a thrusting and slashing weapon derived from a weapon formerly used by cavalry soldiers.

Bouts are conducted on a strip approximately 1.5 to 2 meters (4.9 to 6.6 feet) wide and 14 meters (46 feet) long. The first fencer to score five touches wins a bout. In formal competition, the weapons are wired and connected to an electrical scoring apparatus so that a light flashes on the sidelines when a touch is scored.

Certain fundamental techniques are common to all three weapons. For example, the attack and defense, the parry, and the riposte techniques. The attack and defense technique is initiated from the basic on-guard position, a crouch assumed with knees flexed, the rear arm crooked upward, and the sword arm partially extended toward the opponent. The parry is a movement of the blade designed to block an attack. The riposte is the return thrust made immediately following a parry. A simple attack is made with one motion and is intended to hit the target before the defender can parry. A compound attack involves two or more blade movements. A running attack, or fleçhe, is used to catch an opponent by surprise. A competitor under attack may use a stop-thrust, a sudden counterattack made by thrusting without lunging.

The basic attacking action used in fencing is a lunge. The lunge is executed by stabbing with the sword arm at the target and thrusting forward on the front, or leading, leg. The attack is successful if a touch is scored on the valid target area. In foil fencing only touches on the torso are counted. In epée competition the entire body is a valid target. In saber fencing the entire area above the hips is a valid target.

The lunge movement begins with the athlete in a substantially upright position. The athlete then thrusts forward, propelling the arm holding the weapon and the leg on the same side of the body as the weapon. The leg on the opposite side of the weapon anchors the lunge. The foot on the propelled leg is called the leading foot and the foot on the anchored leg is called the trailing foot. A proper lunge requires aligning the longitudinal axis of the leading foot with the lunge direction. The longitudinal axis of the trailing foot should be substantially perpendicular to the longitudinal axis of the leading foot. Thus, fencing is a sport involving asymmetrical foot movements. Other sports involving asymmetrical foot movements are, for example, high jumping, sprinting, running, and the like.

Athletes involved in these types of sports have usually improvised solutions for improving performance, such as, wearing a different kind of shoe on each foot. For example, a high jumper might wear a sprinting shoe on the kick-off foot and a high jump shoe on the take-off foot; however, the performance improvement, real or perceived, experienced by combining shoes from two different sports is often tempered by the lack of stability, support, cushioning, and flexibility involved in using a different kind of shoe on each foot.

Accordingly, a need exists for athletic shoes adapted for sports involving asymmetric foot movements, such as fencing, that allow each foot to perform optimally. A need also exists for athletic shoes that provide each foot with stability, support, cushioning, and flexibility as dictated by the basic asymmetric movements of the specific sport.

SUMMARY OF THE INVENTION

Embodiments of the present invention can be used in a variety of sports that require asymmetric movements of the feet such as fencing; however, the embodiments will be discussed herein primarily in connection with fencing shoes, by way of example only.

In one aspect, the shoes of the present invention comprise a trailing shoe and a leading shoe. The trailing and leading shoes each comprise an upper and a sole and are specially adapted to the particular asymmetric movement of the trailing and leading foot, respectively, allowing each foot to perform optimally. The trailing shoe sole includes a lateral portion and an opposed medial portion, the lateral sole portion having a greater thickness than the medial portion.

According to one embodiment, the trailing shoe sole includes a front portion and a rear portion. The front portion of the trailing shoe sole has a first difference in the respective thicknesses of the lateral and medial portions. The rear portion of the trailing shoe sole has a second difference in the respective thicknesses of the lateral and medial portions. The second difference in thickness is greater than the first difference, for example, six millimeters and five millimeters, respectively. The trailing shoe may also include a midsole and an outsole.

According to another embodiment, the trailing shoe and the leading shoe may each include heel cushioning. Generally, the heel cushioning of the leading shoe would be thicker than the heel cushioning of the trailing shoe. In addition, the leading shoe may include a heel cup, a protective toe patch, and an overlay. The heel cup is positioned at a heel end of the leading shoe upper for stabilizing the heel and minimizing the impact forces. The protective toe patch is positioned at a toe end of the leading shoe upper for protecting against toe jamming. The overlay is secured under a lace throat of the leading shoe for preventing excessive wear.

Further embodiments of the trailing shoe may include additional features. For example, a performance plate may extend along the length of the trailing shoe and in proximity to the shoe sole. The performance plate may extend an entire foot length and be a full forefoot wide and may be constructed of a thin material resilient to flexures. In addition, the performance plate can be tuned to a predetermined stiffness to minimize dissipation of energy, for example, during a lunge movement. The trailing shoe may also include a high abrasion insert located on the forefoot area of the shoe and extending from the medial portion of the trailing shoe sole to the upper. Also, the trailing shoe may include an asymmetrical upper having a medial side and a lateral side, the asymmetrical upper extending higher on the medial side than on the lateral side. The asymmetrical upper may include a tongue stitched, or otherwise secured, to the medial side and left unattached on the lateral side for promoting stability on the medial side and flexibility on the lateral side.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different figures. Also, the drawings are not to scale emphasis instead generally being placed upon illustrating the principles of the invention. Embodiments of the present invention are discussed in the following description with reference to the drawings, wherein.

DESCRIPTION

Embodiments of the present invention are described below. It is, however, expressly noted that the present invention is not limited to these embodiments, but rather the intention is that equivalents and modifications that are apparent to a person skilled in the art are also included. In particular, the present invention is not intended to be limited to fencing shoes, but rather to be used for all types of footwear used for sports that require asymmetric movement of the feet.

Figure 1:
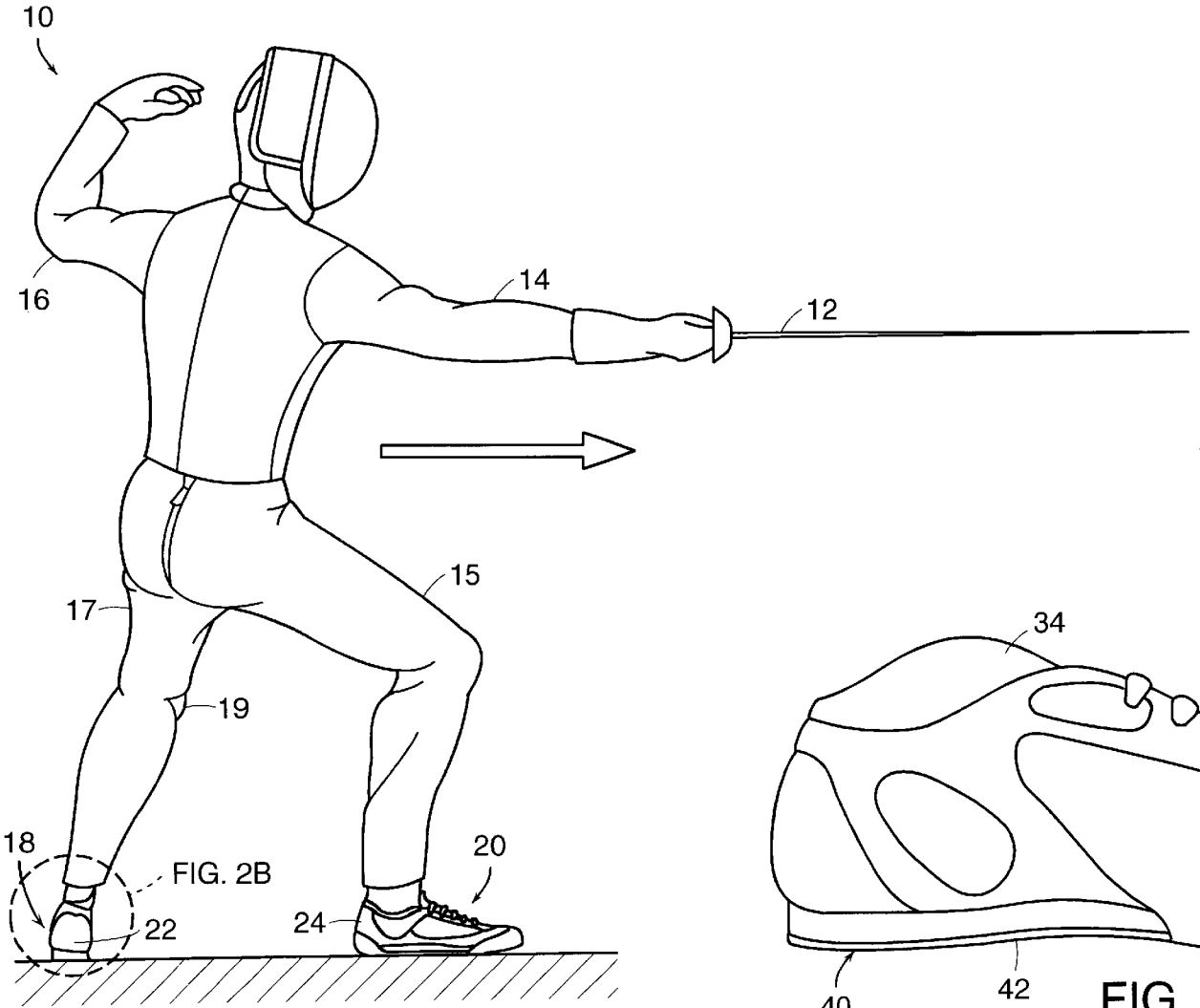
FIG. 1 is a side perspective view of a lunge movement in fencing.
Figure 2A:
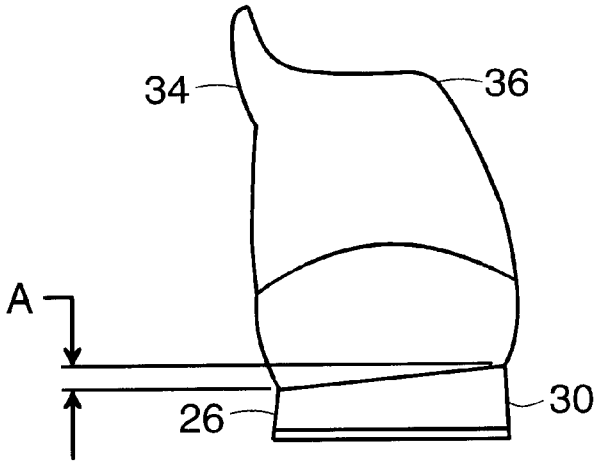
FIG. 2A is a schematic front view of a trailing shoe according to the present invention.

FIG. 1 depicts the lunge movement 10, which begins with the athlete in a substantially upright position. The athlete thrusts forward, propelling the arm 14 holding the weapon 12 and the leg 15 on the same side of the body as the weapon 12 forward. The leg 17 on the opposite side of the weapon 12 anchors the lunge 10. The foot on the propelled leg is called the leading foot 20 and the foot on the anchored leg is called the trailing foot 18. A proper lunge requires aligning the longitudinal axis of the leading foot 20 with the lunge direction. The longitudinal axis of the trailing foot 18 should be substantially perpendicular to the longitudinal axis of the leading foot 20.

Figure 2B:
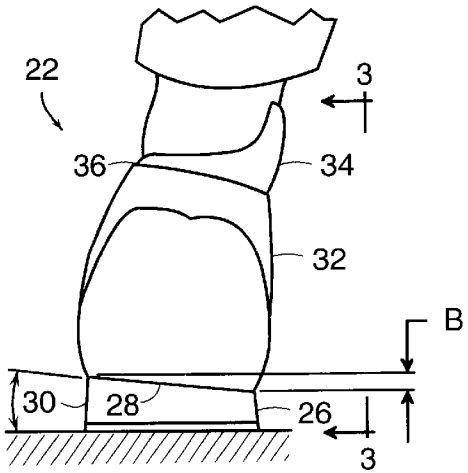
FIG. 2B is a schematic back view of a trailing shoe.
Figure 3:
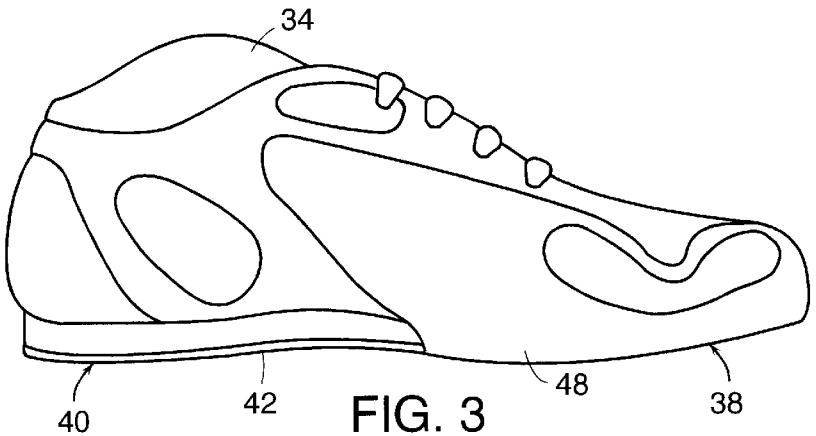
FIG. 3 is a schematic side view of a trailing shoe.

One embodiment of asymmetric shoes in accordance with the present invention is shown in FIGS. 2A–4. The trailing shoe 22 of the present invention comprises a wedged sole 28 and an asymmetrical upper 32. The wedged sole 28 comprises a medial portion 26 and a lateral portion 30. The lateral sole portion 30 has a greater thickness than the opposed medial portion 26. The wedged sole 28 additionally comprises a front portion 38 and a rear portion 40 (FIG. 3). The front portion 38 of the wedged sole 28 has a first difference "A" (FIG. 2A) in the respective thicknesses of opposed lateral and medial portions 30, 26. Similarly, the rear portion 40 of the wedged sole 38 has a second difference "B", shown in FIG. 2B, in the respective thicknesses of opposed lateral and medial portions 30, 26. The second difference in thickness, B, is greater than the first difference, A. Preferably, the first difference in thickness, A, is about 5 millimeters and the second difference in thickness "B" is about 6 millimeters.

Figure 4:
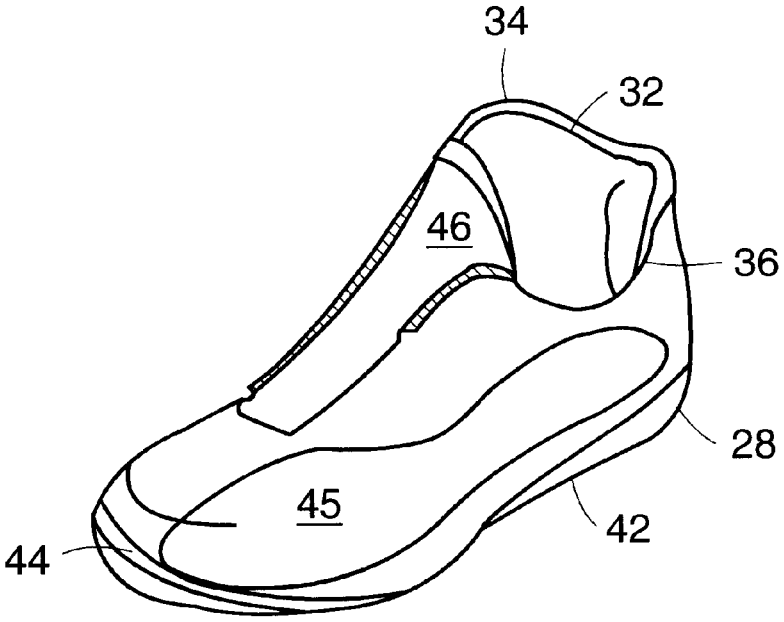
FIG. 4 is a top perspective view of a trailing shoe.

Referring to FIG. 4, the wedged sole 28 comprises a midsole 44 and an outsole 42. The wedged sole 28 can be provided by molding a wedged shaped midsole 44. The wedged sole 28 enhances the ability of the trailing foot 22 to push during the lunge 10, as shown in FIG. 1. The wedged sole 28 also decreases stress in the knee 19 during the lunge movement.

Referring to FIGS. 2A, 2B, 3 and 4, the asymmetrical upper 32 comprises a medial side 34 and a lateral side 36. The asymmetrical upper 32 extends higher on the medial side 34 than on the lateral side 36. The asymmetrical construction of the upper 32 provides support to the ankle during push off, as needed, without comprising flexibility. To promote stability on the medial side 34 and flexibility on the lateral side 36 an optional tongue 46 may be stitched to the medial side 34 and be left loose on the lateral side 36.

The wedged sole 28 may be constructed of elastic materials such as EVA or a combination of elastic and visco-elastic materials, where the visco-elastic material may be provided on the medial portion 26 of the sole from the toe to the heel.

The trailing shoe 22 depicted in FIG. 3 includes a high abrasion insert 48 for enhancing the durability of the shoe. The insert 48 is shown located on the medial side of the trailing shoe in the forefoot area. The high abrasion insert 48 prolongs the life of the shoe by protecting against heavy abrasion due to the dragging of the trailing shoe 22 as associated with the lunge movement 10. The high abrasion insert 48 may be made of leather, synthetic materials, semi-rigid materials, or elastomers such as rubber, and the like.

Referring to FIG. 4, the trailing shoe 22 and the leading shoe 24 (not shown) may optionally include a performance plate 45. The performance plate 45 is a thin sheet of resilient material that extends along a length of and in proximity to the wedged sole 28. In one embodiment, the performance plate 45 extends a full foot length and is a full forefoot wide. The performance plate 45 may be tuned to a predetermined stiffness to minimize dissipation of energy during the lunge 10.

Figure 5:
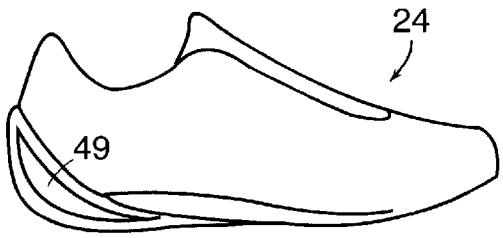
FIG. 5 is a schematic side view of a leading shoe according to the present invention.

The leading shoe 24 is shown in FIGS. 5–8. Referring to FIG. 5, the heel of both the trailing and leading shoes 22 and 24, respectively, may include cushioning. The optional heel cushioning 49 of the leading shoe 24 would typically be thicker than any heel cushioning that might be included in the trailing shoe 22. The lack of or difference in heel cushioning allows the trailing foot 18 to be closer to the ground and in a more natural position for performance and stability. Thicker heel cushioning 49 in the leading shoe 24 accommodates for the higher impact forces encountered by the leading foot 20 during the lunge 10. Unlike the trailing shoe 22, the leading shoe 24 generally does not include an asymmetric upper 32 that extends higher on the medial side 34. The asymmetric upper is not necessary on the leading shoe 24 because the foot moves in the lunge direction and, thus, does not require additional stability during push off. Similarly, the leading shoe 24 generally does not include the high abrasion insert 48 because the leading shoe 24 does not drag during the lunge movement 10.

Figure 6:
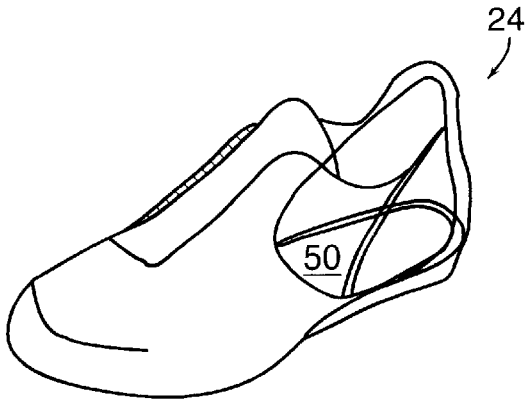
FIG. 6 is a top perspective view of a heel cup included in a leading shoe.
Figure 7:
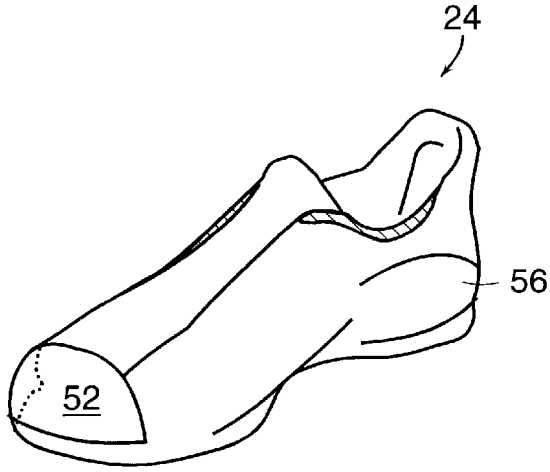
FIG. 7 is a top perspective view of a toe patch included in a leading shoe.
Figure 8:
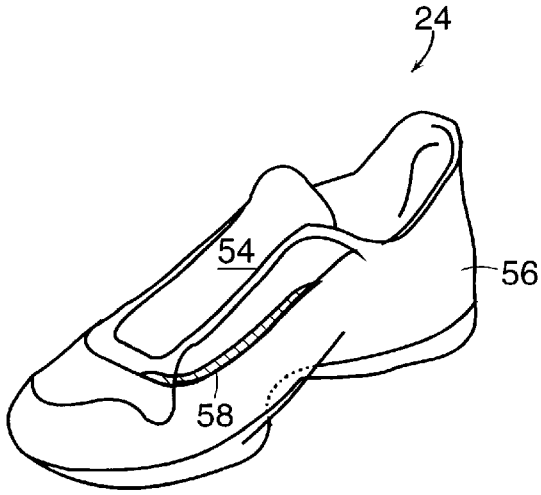
FIG. 8 is a top perspective view of an overlay included in a leading shoe.

Referring to FIGS. 6–8, the leading shoe 24 includes a heel cup 50, a toe patch 52, and an overlay 54. The heel cup 50 is located at a heel end of the leading shoe 24 and provides stability to the heel. The heel cup 50 can be incorporated into a heel reinforcement that includes the heel cushioning 49 of the leading shoe 24. The heel cup 50 absorbs the impact forces on the heel thereby minimizing jarring of the heel. The toe patch 52 is positioned at the toe end or tip of the leading shoe 24. The toe patch 52 has a curved shape that protects the toes from jamming during the lunge 10. The heel cup 50 and the toe patch 52 can be made of a variety of semi-rigid materials including plastic. Excessive wear may be reduced by providing the leading shoe 24 with an upper 56 that includes a wear resistant overlay 54 stitched under the lace throat 58.

Figure 9:
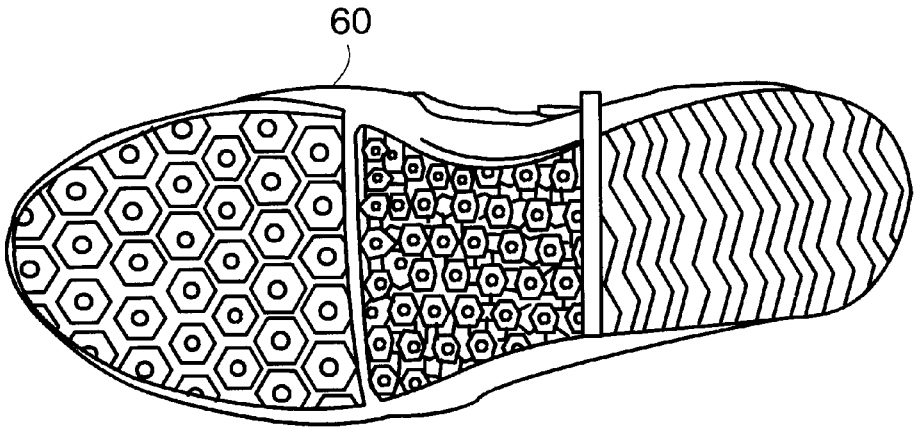
FIG. 9 is a schematic bottom view of a sole of a trailing or leading shoe according to the present invention.
Figure 10:
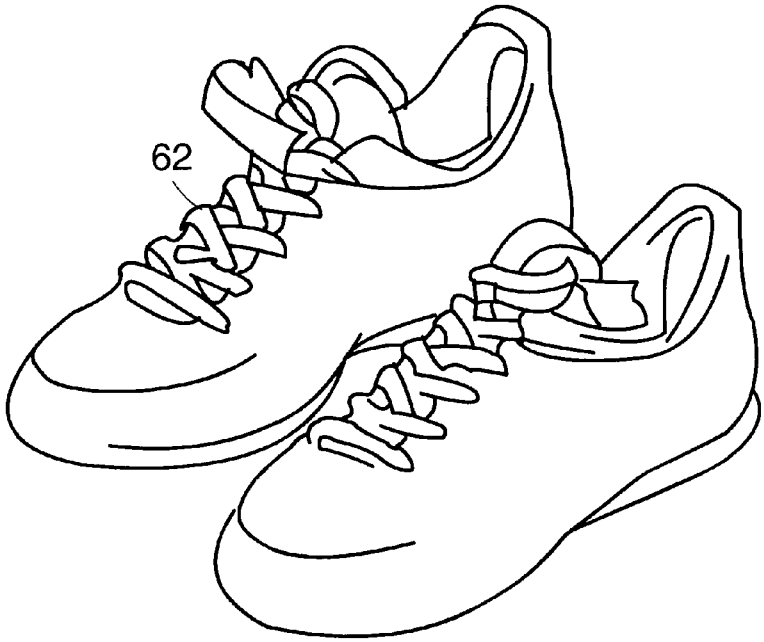
FIG. 10 is a top perspective view of a lace security system of trailing and leading shoes according to the present invention.

Both the trailing shoe 22 and the leading shoe 24 include optimized outsole patterns 60 as shown in FIG. 9. The outsole patterns 60 maximize shoe performance by providing a higher coefficient of friction than conventional fencing shoes. A higher coefficient of friction is preferred for advancing and retreating (scoring and defending) since these movements are extremely fast, particularly among top athletes. The outsole patterns 60 need not be the same for the trailing and leading shoes 22, 24, but may be optimized according to the movement of each foot. The trailing and leading shoes 22, 24 also include a lace security system 62 shown in FIG. 10 that keeps laces tight and out of the way during competition. The lace security system 62 ensures that athletes are not distracted during their short bouts by having to stop the bout to lace their shoes.

Having described embodiments of the invention, it will be apparent to those of ordinary skill in the art that other embodiments incorporating the concepts disclosed herein can be used without departing from the spirit and the scope of the invention. The described embodiments are to be considered in all respects only as illustrative and not restrictive. Therefore, it is intended that the scope of the present invention be only limited by the following claims.

What is claimed is:

1. A pair of shoes, comprising:

a leading shoe including an upper and a sole; and a trailing shoe including an upper and a sole wedged from a front portion to a rear portion with a substantially planar ground engaging surface extending from the rear portion to the front portion of the trailing shoe, the trailing shoe sole further comprising a lateral portion and an opposing medial portion, wherein the lateral portion is constructed with a thickness greater than that of the opposing medial portion along an entire longitudinal span of the sole, and the trailing shoe further comprising a high abrasion insert extending from a bottom of the medial portion of the sole to the upper.

2. The pair of shoes of claim 1, wherein:

the trailing shoe sole front portion is constructed with a first difference in the thickness between the lateral portion and the medial portion; and the trailing shoe sole rear portion is constructed with a second difference in the thickness between the lateral portion and the medial portion.

3. The pair of shoes of claim 2, wherein the second difference in thickness is greater than the first difference in thickness.

4. The pair of shoes of claim 2, wherein the first difference in thickness is about 5 mm and the second difference in thickness is about 6 mm.

5. The pair of shoes of claim 1, wherein the trailing shoe sole further comprises a midsole and an outsole.

6. The pair of shoes of claim 5, wherein the trailing shoe further comprises a performance plate extending along a length of the shoe constructed of a thin material resilient to flexures.

7. The pair of shoes of claim 1, wherein the trailing shoe further comprises an asymmetrical upper having a medial side and a lateral side, the asymmetrical upper extending higher on the medial side than on the lateral side.

8. The pair of shoes of claim 7, wherein the asymmetrical upper includes a tongue attached to the medial side and left unattached on the lateral side for promoting stability on the medial side and flexibility on the lateral side.

9. The pair of shoes of claim 1, wherein the trailing shoe and the leading shoe each include heel cushioning, the heel cushioning of the leading shoe being thicker than the heel cushioning of the trailing shoe.

10. The pair of shoes of claim 1, wherein the leading shoe further comprises a heel cup positioned at a heel end of the upper for stabilizing a heel and reducing impact forces transmitted to the heel.

11. The pair of shoes of claim 1, wherein the leading shoe further comprises a protective toe patch positioned at a toe end of the upper for protecting against toe jamming.

12. The pair of shoes of claim 1, wherein the leading shoe further comprises an overlay stitched under a lace throat for preventing excessive wear.

13. The pair of shoes of claim 1, wherein the ground engaging surface comprises a pattern for providing an increased coefficient of friction to improve traction.

* * * * *